US009089883B2

(12) United States Patent
Stoeters et al.

(10) Patent No.: US 9,089,883 B2
(45) Date of Patent: Jul. 28, 2015

(54) METHOD FOR WASHING A MICROFLUIDIC CAVITY

(75) Inventors: Wolfgang Stoeters, Muelheim/Ruhr (DE); Ying Yu, Dortmund (DE); Silke Knoll, Duisburg (DE)

(73) Assignee: Boehringer Ingelheim International GmbH, Ingelheim am Rhein (DE)

( * ) Notice: Subject to any disclaimer, the term of this patent is extended or adjusted under 35 U.S.C. 154(b) by 180 days.

(21) Appl. No.: 13/877,719

(22) PCT Filed: Oct. 4, 2011

(86) PCT No.: PCT/EP2011/067341

§ 371 (c)(1),
(2), (4) Date: Sep. 11, 2013

(87) PCT Pub. No.: WO2012/045754

PCT Pub. Date: Apr. 12, 2012

(65) Prior Publication Data

US 2014/0150890 A1 Jun. 5, 2014

(30) Foreign Application Priority Data

Oct. 7, 2010 (EP) ..... 10186833

(51) Int. Cl.

| | |
|---|---|
| ***B08B 3/00*** | (2006.01) |
| ***B08B 3/04*** | (2006.01) |
| ***B01L 3/00*** | (2006.01) |
| ***B01L 99/00*** | (2010.01) |

(52) U.S. Cl.

CPC ..... *B08B 3/04* (2013.01); *B01L 3/5027* (2013.01); *B01L 3/502738* (2013.01); *B01L 99/00* (2013.01); *B01L 2200/141* (2013.01)

(58) Field of Classification Search

CPC . B01L 3/502738; B01L 3/5027; B01L 99/00; B01L 2200/141; B08B 3/04

USPC ..... 137/15.04, 15.05, 238, 240; 134/21, 26, 134/30; 420/502

See application file for complete search history.

(56) References Cited

U.S. PATENT DOCUMENTS

| | | | | |
|---|---|---|---|---|
| 6,345,642 | B1 * | 2/2002 | Yoshidome et al. | 137/240 |
| 6,581,625 | B1 * | 6/2003 | Arai et al. | 137/240 |

(Continued)

OTHER PUBLICATIONS

International Search Report, Form PCT/ISR/210, and Written Opinion, Form PCT/ISR/237, for cooresponding application PCT/EP2011/067341, Date of mailing Dec. 5, 2011.

*Primary Examiner* — Jessica Cahill

(74) *Attorney, Agent, or Firm* — Michael P. Morris; Alan R. Stempel

(57) ABSTRACT

The invention relates to a method for washing at least one cavity (20') in a microfluidic component, the cavity (20') containing a first liquid (F1) and at least one second liquid (F2) being supplied to the cavity (20') for washing.

Figure 1:
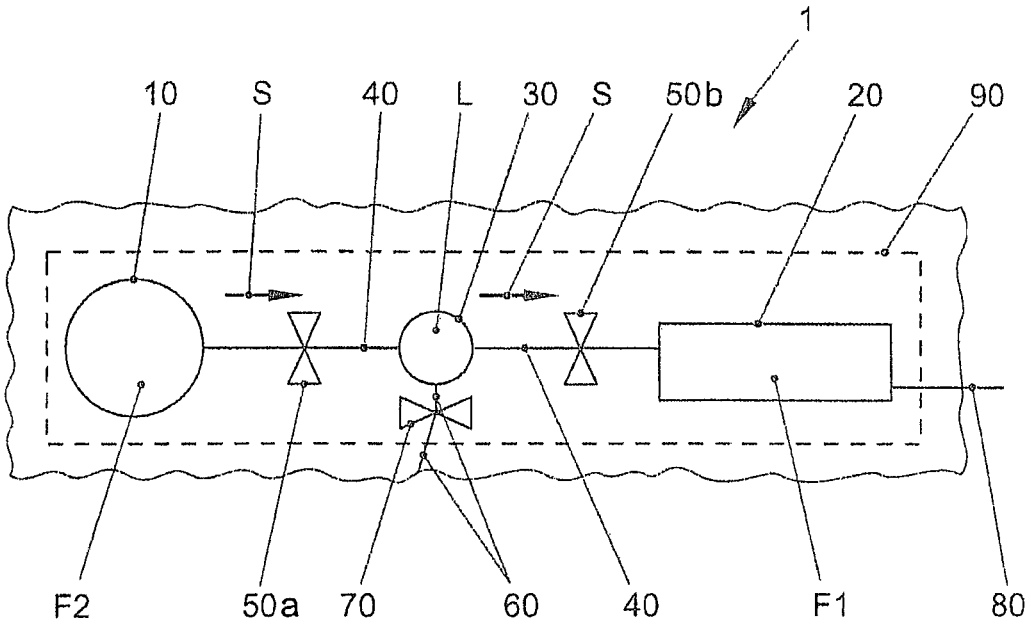

According to the invention an air bubble (L) is supplied to the cavity (20') before the washing liquid (F2) is introduced.

The air bubble (L), which acts as a virtual barrier layer between the first liquid (F1) and the washing liquid (F2) that follows it enables the washing efficiency to be increased considerably. Overall, this method leads to a saving in washing liquid (F2) and washing time.

Moreover, a microfluidic component is proposed for carrying out the method.

15 Claims, 3 Drawing Sheets

(56) References Cited

U.S. PATENT DOCUMENTS

| | | | | |
|---|---|---|---|---|
| 8,226,774 | B2 * | 7/2012 | Labib et al. | 134/22.12 |
| 2001/0035199 | A1 * | 11/2001 | Fillipi et al. | 134/18 |
| 2001/0045219 | A1 * | 11/2001 | Fillipi et al. | 134/12 |
| 2004/0063217 | A1 | 4/2004 | Webster et al. | |
| 2005/0249641 | A1 * | 11/2005 | Blankenstein et al. | 422/102 |
| 2008/0038839 | A1 | 2/2008 | Linder et al. | |
| 2008/0069739 | A1 | 3/2008 | Ludwig | |
| 2010/0143194 | A1 | 6/2010 | Lee et al. | |

* cited by examiner

METHOD FOR WASHING A MICROFLUIDIC CAVITY

The invention relates to a method for washing a cavity in a microfluidic component. The invention also relates to a microfluidic component for carrying out such a method.

In recent years biotechnology and gene technology have acquired enormous importance. A basic task of this technology is the analysis of biological molecules such as DNA (deoxyribonucleic acid) or RNA (ribonucleic acid), proteins, polypeptides, etc. For many medical applications molecules in which heritable information is coded are of particular interest. By detecting them, for example, in a patient's blood sample, it is possible inter alia to detect pathogens, thus making it easier for the doctor to arrive at a diagnosis.

In biotechnology and gene technology there is increasing use of microfluidic components and/or microfluidic cartridges.

Microfluidic cartridges are widely used in the form of one-time tests, generally using so-called lateral flow cartridges, the components of which have length and width dimensions ranging from a few millimeters to several centimeters.

Tests are carried out by supplying a liquid for analysis (such as blood, urine or saliva) to a cartridge provided with a biosensor. The addition of the sample to the cartridge takes place before or after the cartridge is inserted in an analyser. The analyte is added through an opening in the cartridge, while the liquid is introduced through microchannels into corresponding sample preparation chambers and sample investigation chambers.

The term "micro" is intended to imply that the channels and/or cavities (chambers) have a dimension on the micron scale, at least in one geometric direction of extent, i.e., the measurements in at least one dimension are less than one millimeter.

By the term "microfluidic" is meant that a pressure-induced and/or capillary flow of liquid takes place through and within the microchannels and/or microcavities.

By the term "microfluidic component" is meant a component that at least comprises microchannels or microcavities of this kind for the storage and transporting of liquids or fluids and gases.

By the term "microfluidic cartridge" is meant a device (optionally consisting of a plurality of microfluidic components) for the analysis of liquids.

It is often difficult to detect low concentrations of biological and inorganic substances in biological samples. The tests (assays) for this type of detection in microfluidic cartridges generally involve a number of process steps which include the binding of a primary antibody, multiple washing steps, the binding of a second antibody, further washing steps, and (depending on the type of detection system) possibly additional enzymatic and washing measures.

The number of steps that are usually required when using microfluidic cartridges of this kind in order to obtain a desired specific signal are time-consuming and labour-intensive. However, with modern microfluidic cartridges there is a need to shorten the measuring time between the addition of the sample liquid and, finally, the appearance of the measured value. This time is extended by the frequent washing steps required, but these are generally desirable and necessary in order to increase the sensitivity and decrease the background values.

In a washing step for a chamber, usually a liquid that has previously been introduced into the chamber (for example the reaction liquid) is washed out by means of a washing liquid introduced into the chamber directly afterwards. Specifically, a quantity of washing liquid is passed through the chamber, whereupon the liquid that is to be washed out of the chamber is mixed with the washing liquid (diffusion) and eliminated from the chamber with the washing liquid.

As the washing process in a microfluidic system generally takes place in the form of a laminar flow with no appreciable turbulent component, the washing liquid cannot sufficiently access the liquid to be washed away particularly in the corner areas of chambers. As a result, residues are left behind in the chamber. This usually requires a multiple repetition of washing steps, but this is counter-productive in terms of achieving the shortest possible measuring time. In addition, this drives up the amount of washing liquid needed and hence also the space taken up by the reservoir and waste, which is undesirable in a minimal-volume microfluidic system.

It is apparent from DE 697 37 857 T2, for example, that the need for a plurality of washing steps is known from the prior art and is viewed as time-consuming and labour-intensive.

It can also be inferred from DE 601 31 662 T2 that washing steps are indeed often necessary but they increase the measuring time with microfluidic cartridges.

The problem on which the invention is based is to provide a method of the generic type for washing a cavity in a microfluidic component in which the efficiency of washing is increased. The invention is also based on the problem of providing a microfluidic component for carrying out the method according to the invention.

The invention therefore starts from a method for washing at least one cavity in a microfluidic component, in which a first liquid is contained in the cavity and at least one second liquid for washing is introduced into the cavity.

It is proposed according to the invention that a gas be supplied to the cavity before the introduction of the washing liquid. This "prewash" makes it possible to reduce significantly the need for washing liquid to be added subsequently that is required in order to bring about a desired reduction in the residual concentration of the liquid in the cavity that is to be washed out. The amount of washing liquid required can thus be reduced and in some cases it is also possible to reduce the washing time or washing steps.

It is very convenient if the gas, in the form of a bubble, i.e., with a defined volume, is passed through the cavity. This makes it possible to implement the method in a microfluidic component or a microfluidic cartridge even without an external gas connection, so that, for example, the gas bubble with a defined volume can be provided in a cavity of the microfluidic component itself.

With respect to the need to reduce the space and materials required, it is very convenient if the gas bubble has a volume that is smaller than the volume of the cavity. However, the volume will obviously be large enough to ensure efficient washing.

Expediently, therefore, the volume of the gas bubble will be selected to be about 40% to 60%, preferably about 50% of the volume of the cavity that is to be washed out. This substantially reduces the amount of gas that has to be stored but is perfectly sufficient to achieve the desired functionality or effect.

In fact, the gas bubble expands continuously, as a result of over pressure, when introduced into the cavity that is to be washed and immediately becomes so wide that it touches the side walls of the cavity. Thus it is able to displace a major part of the liquid contained in the cavity and needing to be washed out, through an outlet opening that will be provided in the cavity. Successive washing liquid in turn displaces the gas bubble towards the outlet opening as well. The gas bubble thus acts as a virtual barrier layer between the first liquid that is to be washed out and the subsequent washing liquid. Finally the gas bubble is expelled from the cavity completely by the washing liquid.

By virtue of the fact that a very high percentage of the liquid that is to be washed out has already been displaced from the cavity by the gas bubble, the washing liquid can readily absorb by diffusion any remaining minor residual amounts of liquid to be washed out and carry them out of the cavity as it advances. In some cases, a single washing step is sufficient to achieve the desired residual concentration.

Although obviously numerous gases (such as nitrogen or noble gases, for example) may be used, it is very expedient to use air as the gas that is to be introduced, as it is cheap and technically easy to provide.

In some cases it may be expedient if the introduction of gas or air and subsequent liquid for washing is repeated several times.

As already mentioned, the invention also sets out to provide a microfluidic component for carrying out the method according to the invention.

The invention starts from a microfluidic component containing at least one first cavity that is filled with a liquid for washing at least one second cavity and means for providing a fluidic connection between the at least one first cavity and the at least one second cavity.

According to the invention at least one further cavity which is filled with a gas is arranged between the first and second cavities, viewed in the direction of flow of the liquid.

If the cavity containing the washing liquid is then acted upon by a pressure, the washing liquid flows in the direction of the cavity containing the gas and pushes the bas bubble along in front of it, into the cavity that is to be washed out, optionally only after a corresponding fluidic connection has been opened up (for example, by means of corresponding valves).

In order to reduce the space taken up for the included cavity or to reduce the amount of gas required, it is very expedient if the at least one additional gas-filled cavity has a volume that is smaller than the volume of the at least one second cavity to be washed. In fact, it has been found that even a volume of gas that is significantly smaller than the volume of the cavity that is to be washed is sufficient to achieve the desired effect.

It has proved very advantageous if at least one valve is connected in front of the gas-filled cavity and at least one valve is connected behind it, viewed in the direction of flow of the liquid. In this way it is possible to prevent unwanted flows of gas or liquid. It is very advantageous if the valves are actuatable. In this way the flow of the liquid or gas can be controlled even better, thereby, inter alia, reducing the risk of unwanted bubbles or foaming as well. Actuation may preferably be effected by means of electric signals or pulses. In contrast to actuatable valves it would also be possible to have non-actuatable valves which would thus only open if a specific threshold pressure were exceeded.

To increase the washing efficiency it is also possible, alternatively or according to a further embodiment of the invention, to configure the cavity that is to be washed out such that, in the direction of flow, the cavity has a first section in which its cross-section broadens out continuously and a second section in which the cross-section of the cavity tapers continuously. A section of constant cross-section is then conveniently arranged between these sections of varying cross-section. Expediently, the first section viewed in the direction of flow should be arranged in the region of the entry opening and the second section in the region of the exit opening.

There may be applications where it is advantageous if the gas-filled cavity can be fluidically connected to at least one other gas reservoir. Here, too, an actuatable valve may expediently be provided for opening up or shutting off a fluidic connection.

In this way it is possible to repeat the steps described (introduction of a gas bubble into the cavity to be washed, expulsion of the gas bubble by means of subsequent washing liquid) several times if necessary, using the microfluidic component or the microfluidic cartridge.

Air is conveniently used as the gas here as well, while the ambient air may serve as a further gas reservoir.

Figure 2:
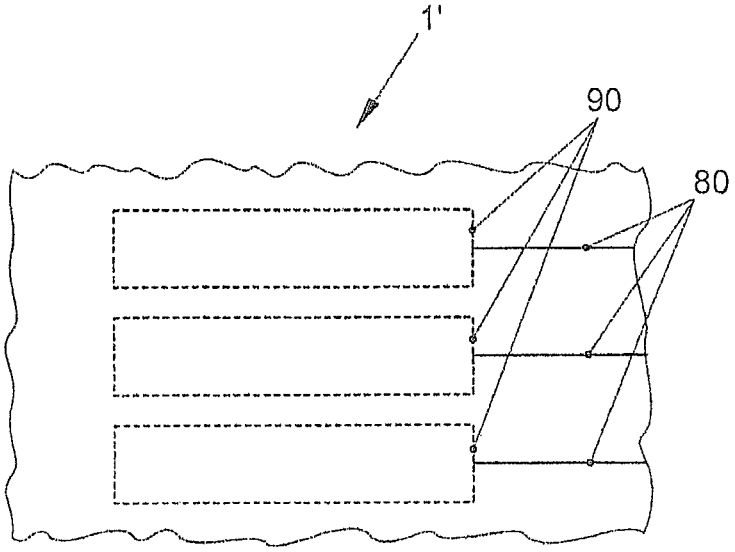
Figure 3A:
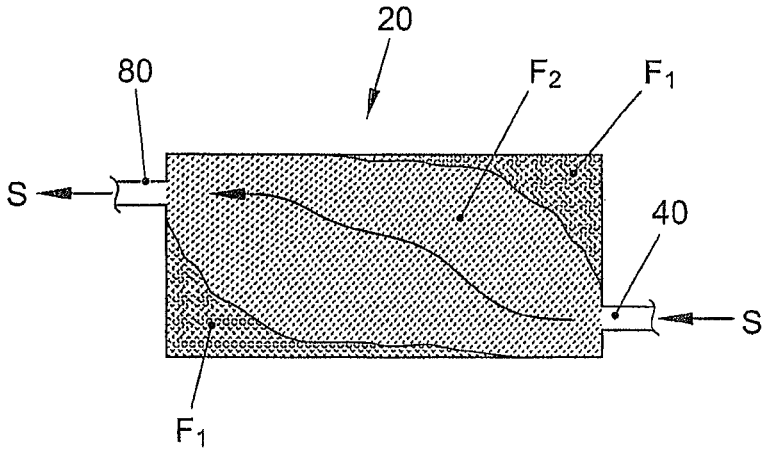
Figure 3B:
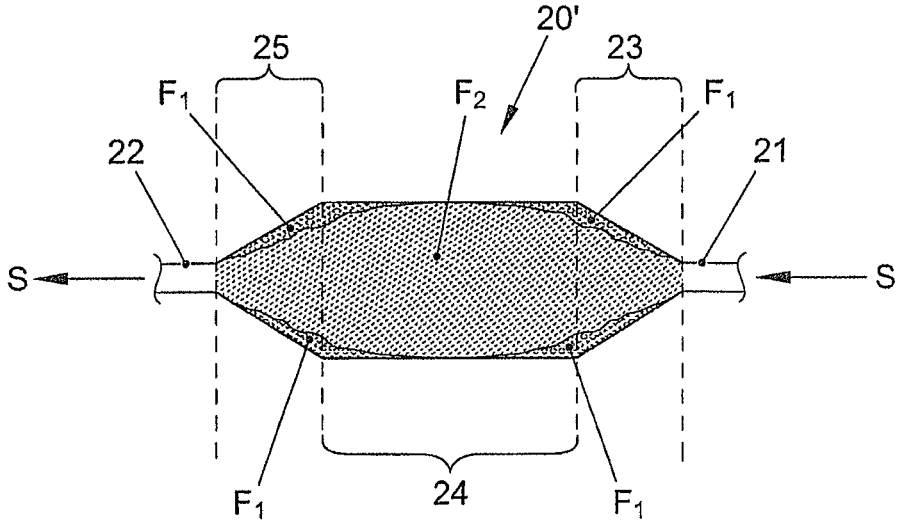

Further advantages and features of the invention will become clear from some embodiments by way of example, as illustrated by means of the accompanying drawings, wherein:

FIG. 1 is a diagrammatical plan view of part of a microfluidic component according to the invention in a first embodiment, FIG. 2 is a diagrammatical plan view of part of a microfluidic component according to the invention in a second embodiment, FIG. 3*a* is a diagrammatical individual view of a cavity that is being washed, in a first embodiment, FIG. 3*b* is a diagrammatical individual view of a cavity that is being washed with a washing liquid, in a second embodiment, FIG. 4 is a diagrammatical representation of the method according to the invention taking a cavity according to FIG. 3*b* as an example.

FIG. 1 shows a detail of a microfluidic component 1. Specifically a plurality of microfluidic functional elements can be seen, which, for the sake of the drawing, are to be associated with a microfluidic functional group 90 (shown within a dashed line border). The microfluidic functional group 90 comprises a first preferably circular chamber 10 filled with washing liquid F2. Also shown is a second substantially rectangular chamber 20 which is filled with a liquid F1.

The liquid F1 has triggered a specific detection reaction in the chamber 20. Some of the biomolecules contained in F1 are bound in the chamber 20. The remainder of F1 is now to be washed out of the chamber 20 with the washing liquid F2. The chamber 20 may be, for example, a PCR chamber (PCR=polymerase chain reaction). The nature of the detection reaction initiated in the chamber 20 by the liquid F1 is, however, of no importance to the understanding of the invention and therefore requires no further explanation.

Between the chamber 10 and the chamber 20 is provided a further chamber 30 which is filled with air L in the embodiment shown. Instead of air, other gases such as nitrogen or the like may naturally be used. The chambers 10, 20 and 30 are fluidically connected to one another by microchannels 40, while between the chambers 10 and 30 or 30 and 20 are provided, in each case, a preferably electrically actuatable valve 50*a* or 50*b*, respectively, by which the fluidic connection can be opened up or interrupted.

Also provided is a more extensive microchannel 80, by which the chamber 20 can be fluidically connected to other microfluidic functional elements not shown here, such as a waste region, for example.

It is also apparent from FIG. 1 that the air-filled chamber 30 is connected to a microchannel 60. The microchannel 60 provides a fluidic connection from the chamber 30 to another gas reservoir. Here, too, the fluidic connection may be broken or opened up by a preferably electrically actuatable valve 70. The above-mentioned gas reservoir itself may be formed by one or more other cavities or chambers (not shown).

When air is used in the chamber 30 an expedient course of action is to fill the gas reservoir that is accessible through the microchannel 60 with air or, through the microchannel 60, to provide only one access to the ambient air or to an air pump (not shown).

Not shown in detail or marked with a reference numeral is a film, preferably attached to the component 1 by adhesive bonding, for covering or sealing the above-mentioned chambers and channels. The component 1 itself is a plastics plate which has preferably been produced by injection moulding.

To initiate a washing process, the chamber 10 in the embodiment shown is now acted upon by a pressure of approximately 0.4 bar to 0.8 bar. This is preferably done by means of suitable actuators of a microfluidic cartridge into which the component 1 has been installed (not shown).

Simultaneously with the application of pressure, the valves 50*a* and 50*b* are actuated, thus opening up the fluidic connection between the chambers 10, 20 and 30. As a result of the build-up of pressure, the washing liquid F2 then flows in the direction of flow S into the chamber 30 and pushes the air L contained in the chamber 30 along in front of it, again in the direction of flow S, in the direction of the chamber 20. Thus, before the washing liquid F2, first the air L in the form of a defined air bubble is forced into the chamber 20. This leads to a very efficient "pre-washing" of the chamber 20. In concrete terms, a major part of the liquid F1 present in the chamber 20 is already displaced by the air L, so that the washing liquid F2 following the air bubble L only has to eliminate the remaining residues of liquid F1 from the chamber 20.

At least in this way the amount of washing liquid F2 that has to be kept in readiness and is needed to produce a required maximum residual amount of liquid F1 to remain in the chamber 20 can be significantly reduced.

If a single washing operation is not sufficient, it is possible to repeat the washing process as described for the desired number of times. For this the valve 50*a* is closed again. Then the valve 70 is opened and a fluidic connection is opened up between the chamber 30 and the air reservoir mentioned above.

In this way the chamber 30 can be filled with air L again, e.g., by means of a pump. After the valve 70 has closed, the valve 50*a* is opened again and there is a build-up of pressure at the chamber 10, as already described. The chamber 10 may optionally be varied in its shape and size as necessary. It is also possible to have a plurality of chambers 10, each of which is associated with a washing step.

The washing process in chamber 20 is described in more detail hereinafter in connection with FIG. 4.

FIG. 2 diagrammatically shows another embodiment 1' of a microfluidic component according to the invention. Unlike the embodiment in FIG. 1, the microfluidic component 1' comprises a plurality of microfluidic functional groups 90 (as described in FIG. 1). Accordingly, a plurality of more extensive microchannels 80 are also provided. They may, for example, be connected to a common waste region.

In this embodiment 1', for example, the reaction and washing steps that are to be carried out in the functional groups 90 may be combined with one another, cascaded or a number of assays may be allowed to run simultaneously.

FIG. 3 now shows two possible geometric configurations of the chamber 20 that is to be washed, although naturally other geometric configurations are possible. The chamber geometry according to FIG. 3*b* constitutes an improvement over the geometry in FIG. 3*a* in terms of the washing efficiency and may usefully be combined with the method according to the invention.

FIG. 3*a* shows that the chamber 20 is configured as shown in FIG. 1. Thus, in plan view, it has a substantially rectangular outline, and both the inlet (microchannel 40) and outlet (microchannel 80) are visible. Here, washing liquid F2 has already passed through the chamber 20 in the direction of flow S.

The diagonal arrangement of the inlet and outlet (40 and 80) in the direction of flow S may indeed improve the efficiency of the washing, but considerable residues of liquid F1 are unavoidable in the corner regions that are not associated with the inlet or outlet, as this method of diagonal washing omits the opposite corners.

An improvement in washing efficiency solely by reconfiguring the chamber geometry is illustrated in FIG. 3*b*.

This shows a chamber 20' which has, in the direction of flow S, an entry opening 21 and an exit opening 22. Adjoining the entry opening 21 is a first section 23 with a continuously widening cross-section of the chamber 20'. Specifically, in this section 23, the opposing walls of the chamber 20' diverge from one another in a V shape, when seen in plan view. Adjoining the section 23 is a section 24 with a constant cross-section of the chamber 20'. Thus, here, the opposing walls of the chamber 20' run substantially parallel. Adjoining the section 24, in turn, is a section 25 in which the cross-section of the chamber 20' becomes continuously smaller. The opposing walls of the chamber 20' converge with one another in a V shape, in the direction of the exit opening 22.

The chamber geometry is thus optimised with regard to the flow pattern of the washing liquid F2. However, even here, it is unavoidable that in the corner regions there will be certain residues of liquid F1 that need to be washed away.

Figure 4A:
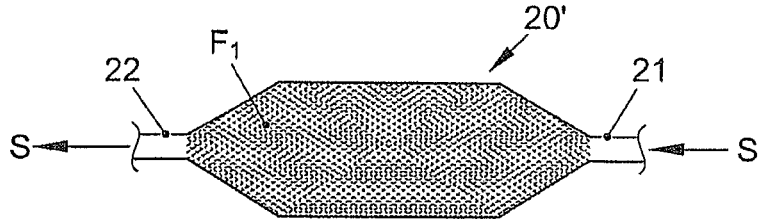
Figure 4B:
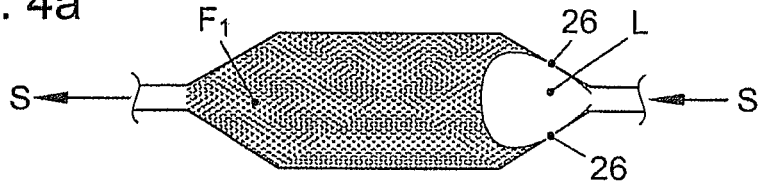
Figure 4C:
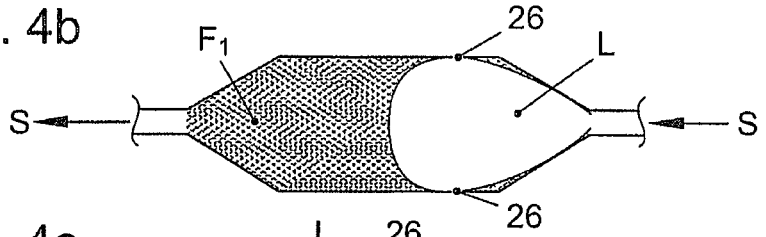

FIG. 4 now shows in detail how the method according to the invention leads to a significant improvement in the washing efficiency:

Thus, the chamber 20' is first of all filled with the liquid F1 that is to be washed away (FIG. 4*a*). After the washing process has been initiated (as described above) first the air bubble L propelled forwards by the washing liquid F2 is forced into the chamber 20', and specifically in the region of the entry opening 21 (FIG. 4*b*) until the whole air bubble L has been forced into the chamber 20' (FIG. 4*c*). It is apparent that the air bubble L will very rapidly spread outwards towards the side walls of the chamber 20' and form contact regions 26 with them.

Figure 4D:
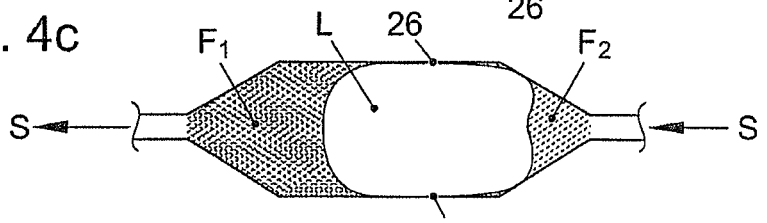

As the washing process continues, the washing liquid F2 following the air bubble L penetrates into the chamber 20' (FIG. 4*d*). The air bubble L and the contact regions 26 result on the one hand in a very good displacement of the liquid F1 towards the exit opening 22, and on the other hand in a very good separation between the liquid F1 and the following liquid F2.

Thus, essentially no diffusion occurs between the liquid F1 and the following liquid F2, with the exception of any (extremely small) residual amounts of liquid F1 remaining behind the contact regions 26, viewed in the direction of flow S.

Figure 4E:
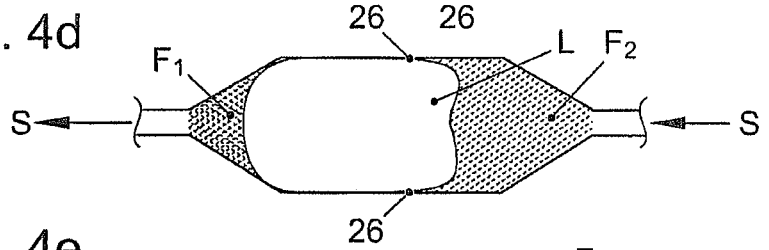

It can be seen from FIGS. 4*d* and 4*e* in particular that the size of the air bubble L by no means has to correspond to the volume of the chamber 20'. All that is required is to ensure that the defined amount of air L in the chamber 30 is large enough to allow an air bubble L to be produced which is large enough to form the above-mentioned contact regions 26 with the chamber 20' and thus act as a virtual barrier layer between the liquid F1 and the following liquid F2.

FIG. 4*e* shows that the air bubble L, which has in turn been displaced by the following liquid F2 in the direction of the exit opening 22, has displaced a very large percentage of the liquid F1 from the chamber 20'.

Figure 4F:
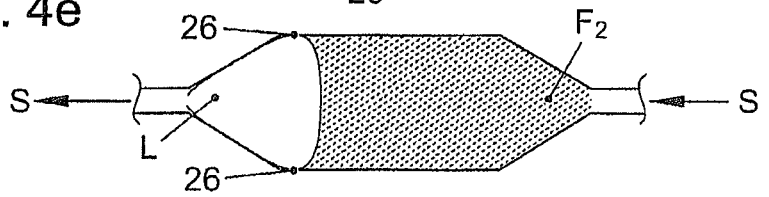
Figure 4G:
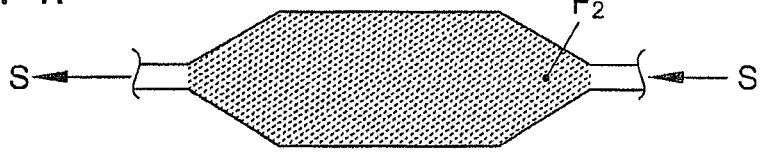

It can be seen from FIGS. 4*f* and 4*g* that the air bubble L is forced into the exit opening 22 by the following liquid F2 and finally only the liquid F2 is present in the chamber 20'. Then only an extremely small residue of liquid F1 that is to be washed away and is still remaining in the chamber 20' has to diffuse with the washing liquid F2.

The result of this is that the amount of washing liquid F2 that is needed to achieve the desired residual concentration of liquid F1 in the chamber 20' can be significantly lowered. The low residual concentrations of liquid F1 that can be achieved can thus be rinsed out by the influx of washing liquid F2 within a short time.

In the present embodiment, good results were achieved with a chamber geometry for the chamber 20' of about 32 $mm^2$ in area, combined with a height of a few hundred μm with volume flows of about 4 μl/sec. Volume flows of from 2 μl/sec to about 10 μl/sec were achievable. A pressure of about 0.4 bar proved extremely satisfactory as the initial pressure for initiating the washing process, but significantly higher pressures of up to about 0.8 bar were also used.

LIST OF REFERENCE NUMERALS

1, 1' microfluidic component
10 first chamber for receiving washing liquid
20, 20' second chamber containing liquid to be washed away
21 entry opening
22 exit opening
23 first section with widening cross-section of the chamber
24 section with constant cross-section of the chamber
25 second section with decreasing cross-section of the chamber
26 lateral contact regions of the air bubble with the wall of the second chamber
30 further chamber for holding air
40 microchannels
50*a, b* actuatable valves
60 microchannel
70 actuatable valve
80 microchannel
90 microfluidic functional group
F1 liquid to be washed away
F2 washing liquid
L air or air bubble
S direction of flow

The invention claimed is:

1. A method for washing at least one reaction chamber (20, 20') in a microfluidic component (1, 1'), the at least one reaction chamber (20, 20') containing a reaction liquid (F1) resulting from a reaction therewithin, the method comprising:

disposing at least one gas chamber (30) upstream from the reaction chamber (20) and connecting the gas chamber (30) to the reaction chamber (20) via an inlet micro-channel;

disposing at least one liquid chamber (10) upstream from the gas chamber (30) and connecting the liquid chamber (10) to the gas chamber (30) via a further micro-channel;

releasing washing liquid from the liquid chamber (10) under pressure through the further micro-channel toward the gas chamber (30) while the reaction liquid is located within the reaction chamber (20);

permitting the washing liquid to force a gas from the gas chamber (30) through the inlet micro-channel and into the reaction chamber (20), thereby driving the reaction fluid from the reaction chamber (20) through an outlet micro-channel and creating a bubble of gas between the washing liquid and the reaction liquid within the reaction chamber (10);

continuing to permit the washing liquid to force the gas into the reaction chamber (20) and drive the reaction fluid from the reaction chamber (20) until substantially all of the reaction liquid is removed from the reaction chamber (10) except for a substantially small residual amount of the reaction fluid; and permitting the washing liquid to advance into the reaction chamber (20), drive the gas out of the reaction chamber (20) through the outlet micro-channel, diffuse with the residual amount of the reaction fluid, and carry the residual amount of the reaction fluid out through the outlet micro-channel.

2. The method according to claim 1, wherein the volume of the bubble of gas (L) corresponds to one of: (i) approximately 40% to 60% of the volume of the reaction chamber (20, 20'), and (ii) approximately 50%, of the volume of the reaction chamber (20, 20').

3. The method according to claim 1, wherein the gas (L) is air.

4. The method according to claim 1, wherein the introduction of the gas (L) and the subsequent washing liquid for washing is repeated several times.

5. The method according to claim 1, wherein the bubble (L) of gas has a defined volume.

6. The method according to claim 5, characterised in that the gas bubble (L) has a volume that is smaller than the volume of the reaction chamber (20, 20').

7. A microfluidic component (1, 1'), comprising:

at least one reaction chamber (20, 20') containing a reaction liquid (F1) resulting from a reaction therewithin;

at least one gas chamber (30) located upstream from, and connected to, the reaction chamber (20) via an inlet micro-channel;

at least one liquid chamber (10) located upstream from, and connected to, the gas chamber (30) via a further micro-channel; and a mechanism operating to release washing liquid from the liquid chamber (10) under pressure through the further micro-channel toward the gas chamber (30) while the reaction liquid is located within the reaction chamber (20), wherein:

the washing liquid is permitted to force a gas from the gas chamber (30) through the inlet micro-channel and into the reaction chamber (20), thereby driving the reaction fluid from the reaction chamber (20) through an outlet micro-channel and creating a bubble of gas between the washing liquid and the reaction liquid within the reaction chamber (10), the washing liquid is continued to be permitted to force the gas into the reaction chamber (20) and drive the reaction fluid from the reaction chamber (20) until substantially all of the reaction liquid is removed from the reaction chamber (10) except for a substantially small residual amount of the reaction fluid; and the washing liquid is permitted to advance into the reaction chamber (20), drive the gas out of the reaction chamber (20) through the outlet micro-channel, diffuse with the residual amount of the reaction fluid, and carry the residual amount of the reaction fluid out through the outlet micro-channel.

8. The microfluidic component (1, 1') according to claim 7, the gas chamber (30) has a volume that is smaller than a volume of the at least one reaction chamber (20, 20') that is to be washed.

9. The microfluidic component (1, 1') according to claim 7, wherein the gas (L) is air.

10. The microfluidic component (1, 1') according to claim 7, wherein, viewed in the direction of flow (S) of the washing liquid (F2), at least one valve (50*a*) is connected in front of the gas chamber (30) and at least one valve (50*b*) is connected behind the gas chamber (30).

11. The microfluidic component (1, 1') according to claim 10, wherein the valves (50*a*, 50*b*) are actuatable.

12. The microfluidic component (1, 1') according to claim 7, wherein the reaction chamber (20') to be washed comprises, in the direction of flow (S), a first section (23) in which the cross-section of the reaction chamber (20') widens out continuously and a second section (25) in which the cross-section of the reaction chamber (20') tapers continuously.

13. The microfluidic component (1,1') according to claim 12, wherein a section (24) of constant cross-section is arranged between the sections (23 and 25) of varying cross-section.

14. The microfluidic component (1, 1') according to claim 7, wherein the gas chamber (30) is fluidically connectable to at least one further gas reservoir.

15. The microfluidic component (1, 1') according to claim 14, wherein the fluidic connection can be provided by an actuatable valve (70).

* * * * *